United States Patent [19]

Rutz

[11] 4,328,739

[45] May 11, 1982

[54] HYDROSTATIC PISTON MACHINE

[75] Inventor: Peter Rutz, Winterthur, Switzerland

[73] Assignee: Sulzer Brothers Ltd., Winterthur, Switzerland

[21] Appl. No.: 116,491

[22] Filed: Jan. 29, 1980

[30] Foreign Application Priority Data

Feb. 26, 1979 [CH] Switzerland ..... 1860/79

[51] Int. Cl.[3] ..... F01B 13/06

[52] U.S. Cl. ..... 91/484; 91/498

[58] Field of Search ..... 91/484, 498; 417/273

[56] References Cited

U.S. PATENT DOCUMENTS

| | | | |
|---|---|---|---|
| 3,744,380 | 7/1973 | Steigor | 417/273 |
| 3,968,734 | 7/1976 | Rutz | 91/498 |
| 4,033,237 | 7/1977 | Rutz | 91/484 |

FOREIGN PATENT DOCUMENTS

| | | | |
|---|---|---|---|
| 1453628 | 7/1968 | Fed. Rep. of Germany | 91/498 |
| 2412718 | 3/1974 | Fed. Rep. of Germany | 91/498 |

*Primary Examiner*—William L. Freeh

*Attorney, Agent, or Firm*—Kenyon & Kenyon

[57] ABSTRACT

The hydrostatic piston machine is provided with hydrostatic bearing pockets at least one of which is provided with an unthrottled flow of high-pressure medium while at least one other pocket is provided with a throttled flow of high-pressure medium. And the pockets are sized relative to each other so that the pockets receiving the unthrottled flow compensate for 70% to 95% of the force on the bearing while the pockets receiving the throttled flow compensate for 30% to 5% of the bearing forces applied.

3 Claims, 7 Drawing Figures

HYDROSTATIC PISTON MACHINE

BACKGROUND OF THE INVENTION

This invention relates to a hydrostatic piston machine.

Heretofore various types of hydrostatic piston machines have been known. For example, one known hydrostatic piston machine has a cylinder block which is rotatable around a pintle and in which peripherally distributed pistons are guided radially in relation to the pintle. Further, the pistons have support surfaces at their outer ends which are guided along plane guiding surfaces of an annular guide member, the guide surfaces being tangential to a circular cylindrical surface whose axis is eccentric of the cylinder block axis. The guide member is in turn, mounted by way of two sidewalls on the pintle about the axis of the circular cylindrical surface. The pintle also has two ports which co-operate with the cylinder block, one port communicating with a bore for a high-pressure hydraulic medium while the other port communicates with a bore for a low-pressure hydraulic medium.

In machines of this kind there are problems for the mountings between the pintle and the cylinder block, and between the pintle and the guide member, particularly if the machine is to be operated in a wide pressure range, e.g. from 100 to 1000 bar, and is also intended for high power outputs, e.g. 1000 HP.

Thus, suitable bearings must be provided to ensure reliable operation. However, the previously known bearings have not been satisfactory. For example, bearings are known which are relieved of load via an oil cushion. Generally, the oil supply to the bearing is unthrottled. In these conditions, the bearing parts contact one another during starting up and during operation, and for this reason the oil must have good lubrication properties. Despite the advantage of low oil losses and low bearing loading in the event of seizure, there are the disadvantages that there is a relatively high bearing friction, the starting characteristic is poor, only oil having good lubricating properties can be used for the bearing, and the maximum possible operating pressure is very limited.

Bearings are also known which have a complete hydrostatic load-relief system. As long as there is a sufficiently high oil pressure, the parts which move in relation to one another do not contact one another. Usually, the oil is supplied to a hydrostatic bearing pocket via a throttle which, together with a bearing gap around the pocket, forms a system which automatically adapts the pressure in the bearing pocket to the bearing load at any time. The friction existing in such bearings during starting up and operation is minimal. It is also possible to use a pressure medium having poor lubricating properties, e.g. silicone oil. However, the disadvantage of such bearings is relatively high oil loss and, in the event of a throttle becoming clogged, the bearing is completely without lubrication and, thus, exposed to the full bearing loading.

Finally, bearings are known which operate with complete hydrostatic relief but without a throttle in the oil supply. In such cases, automatic regulation of the pressure in the bearing pocket is impossible; the magnitude of the bearing gap may be zero or large at any pressure. Such bearings thus have an unstable characteristic and a relatively high oil loss. Further, it is difficult to dimension the bearing pocket because the pressure profile of the pocket cannot be accurately defined. This difficulty applies particularly if the machine is intended for high operating pressures. On the other hand, a bearing of this kind has the advantage of reduced friction and the fact that the bearing loading on seizure is less than with the other two types of bearing mentioned above.

Accordingly, it is an object of the invention to improve the mounting of a cylinder block on a pintle of a hydrostatic piston machine.

It is another object of the invention to improve the mounting of a guide member on a pintle of a hydrostatic piston machine.

It is another object of the invention to provide for a reliable operation of a hydrostatic piston machine over a wide pressure range and with high outputs.

Briefly, the invention is directed to a piston machine comprised of a pintle, a cylinder block which is rotatably mounted on the pintle, a plurality of peripherally distributed pistons slidably mounted in the cylinder block radially relative to the pintle and a guide member about the pistons which has a pair side walls rotatably mounted on the pintle. Each of the pistons is provided with a support surface at an outer end while the guide member is provided with a plurality of plane guide surfaces, each of which has a respective piston support surface guided thereon. In addition, each of the guide surfaces is disposed tangentially of circular cylindrical surface having an axis eccentric to the axis of the pintle.

In addition, a pair of ports are provided in the pintle in facing relation to the cylinder block and a pair of bores are provided in the pintle interior to conduct a high-pressure hydraulic medium and a low-pressure hydraulic medium to and from the respective ports.

In accordance with the invention, the high-pressure bore communicates with one of the ports to deliver or discharge an unthrottled flow of high-pressure hydraulic medium thereto or therefrom respectively while the second bore communicates with the other port to discharge or deliver low-pressure hydraulic medium therefrom or thereto respectively. In addition, a pair of hydrostatic bearing pockets are provided in the pintle facing the cylinder block on opposite sides of the high-pressure port. Each of these bearing pockets connects via a throttle with the high-pressure bore such that a throttled flow of high-pressure medium is delivered by the throttle to the respective pockets.

In addition, a second pair of hydrostatic bearing pockets are provided in the pintle and each of these pockets facing a respective side wall on the opposite side of the pintle from the high-pressure port. Also, a throttle connects each of these pockets to the high-pressure bore conducting a throttled flow of high-pressure medium. Still further, a further pair of bearing pockets are formed in the pintle with each pocket facing a respective side wall on a side opposite the high-pressure port. Further, each of these pockets communicates with the high-pressure bore to receive an unthrottled flow of high-pressure medium therefrom.

With this configuration, at least two hydrostatic bearing pockets are provided at each bearing point, at least one of them having an unthrottled pressure medium supply and at least one having a throttled pressure medium supply. The advantage of this is that the share of the two bearing pockets in the partial relief of the bearing can be adjusted within specific limits, i.e. by altering the cross-sections of the throttles. The throttles cross-sections can be so dimensioned that perfect conditions relative to the bearing clearance apply throughout the range of operation. Generally, the main share of the relief will be assigned to the bearing pockets having the unthrottled pressure medium supply. If one of the throttles breaks down due to clogging, the bearing loading is still relatively small because the bearing pocket with the unthrottled pressure medium supply remains intact. Another advantage is that a pressure medium having poor lubricating properties can be used for the machine.

FIG. 1 diagrammatically illustrates a view taken on line I—I of FIG. 2 of a hydrostatic machine according to the invention;

Figure 6:
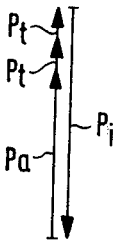
Figure 7:
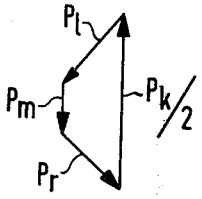

FIG. 6 diagrammatically illustrates the forces acting between the cylinder block and pintle in accordance with the invention; and FIG. 7 diagrammatically illustrates the forces acting between a side wall of the guide member and a pintle in accordance with the invention.

Figure 1:
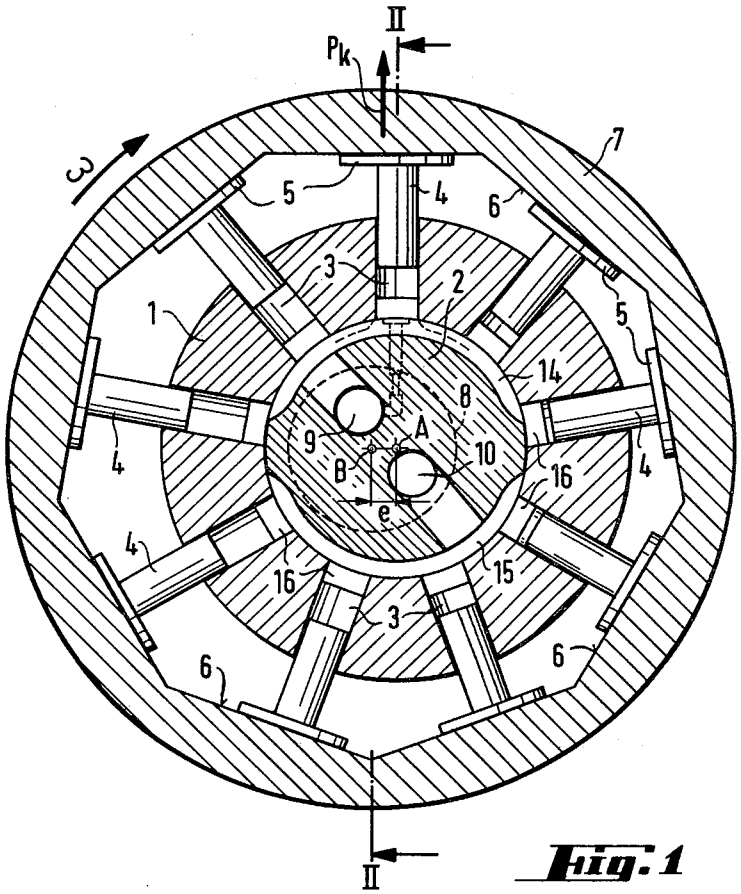
Figure 2:
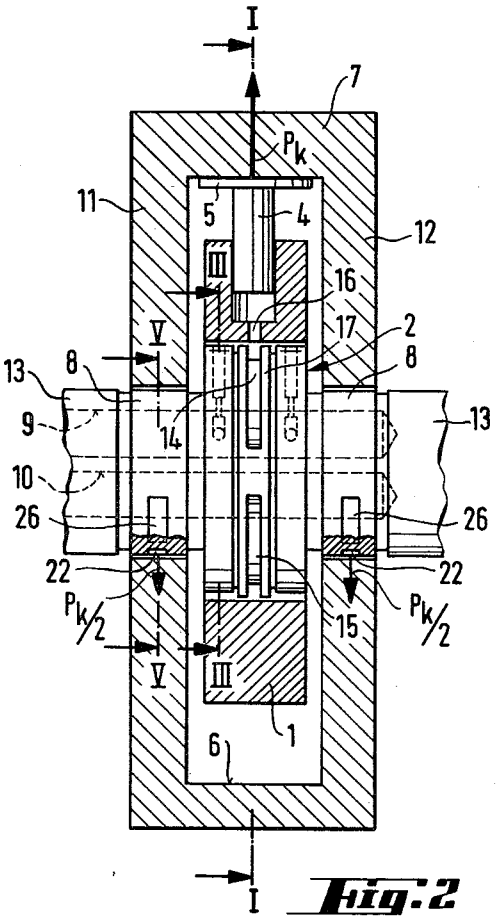
FIG. 2 illustrates a view taken on line II—II of FIG. 1.

Referring to FIGS. 1 and 2, the hydrostatic piston machine comprises a cylinder block 1 which is rotatably mounted on a cylindrical pintle 2 having a longitudinal axis A. A plurality (e.g. nine) of peripherally distributed pistons 4 are slidably mounted in radial cylinder bores 3 in the cylinder block 1 so as to be guided radially relative to the pintle 2. Each of these pistons 4 has a foot 5 at the outer end which has a plane support surface thereon. In addition, an annular guide member 7 is disposed about the pistons 4 and has a plurality of plane guide surfaces 6 for guiding the respective pistons 4 thereon. Each of the guide surfaces 6 is disposed, in known manner, tangentailly of a circular cylinder surface having an axis B which is eccentric to the axis A of the pintle 2.

The pintle 2 is provided with a pair of cylindrical portions 8 on opposite sides while the guide member 7 is provided with a pair of discoid side walls 11, 12 which are rotatably mounted on the cylindrical portions 8. As shown in FIG. 2, the cylindrical portions 8 are followed by cylindrical portions 13 which are fixed in a stationary machine housing (not shown) which surrounds the various components described.

A pair of axial parallel bores 9, 10 which are used to supply and discharge hydraulic pressure medium extend through the left hand, as viewed, cylindrical portion 13, the cylindrical portions 8 and the pintle 2 therebetween. Depending on whether the machine is operated as a pump with just one direction of rotation, or as a motor with an alternating direction of rotation, the supply and discharge function of the bores 9, 10 will be constant or changed.

The pintle 2 also has two control ports 14, 15 facing the cylinder block 1 which extend transversely of the axis over somewhat less than half the periphery of the pintle 2 and which communicate with the respective bores 9, 10. Connecting ducts 16 are provided in the cylinder block 1 in line with ports 14, 15 and extend toward the pintle 2 as extensions of the cylinder bores 3. When the machine is in operation the ducts 16 establish connections between these cylinder bores 3 beneath the pistons 4 and the associated control ports 14, 15. When the machine is operating as a motor the bore 9 serves to deliver an unthrottled flow of high-pressure medium to the control port 14 while the bore serves to discharge low-pressure hydraulic medium from the control port 15.

Figure 4:
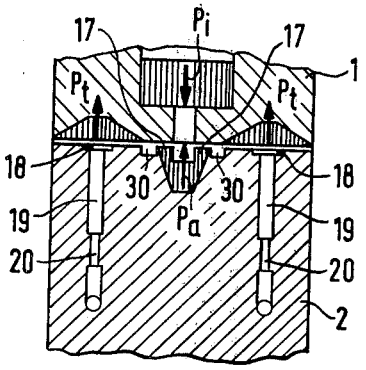
FIG. 4 illustrates a view taken on line IV—IV of FIG. 3.
Figure 3:
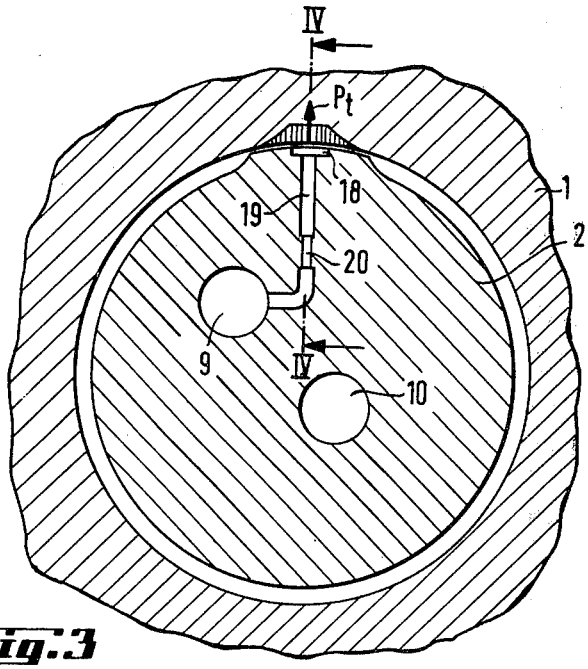
FIG. 3 illustrates a view taken on line III—III of FIG. 2.

Referring to FIG. 4, a web 17 extends on each side of the port 14 and is of an axial width which determines the magnitude of the hydraulic force acting in a gap between the pintle 2 and the cylinder block. In addition, a pair of hydrostatic bearing pockets 18 are provided in the pintle 2 facing the cylinder block 1 on opposite sides of the control port 14 outside of the webs 17. As shown in FIG. 3, each pocket 18 communicates with the axial bore 9 via a duct 19 and a throttle 20. Each throttle 20 serves to deliver a throttled flow of high-pressure medium to a pocket 18.

Figure 5:
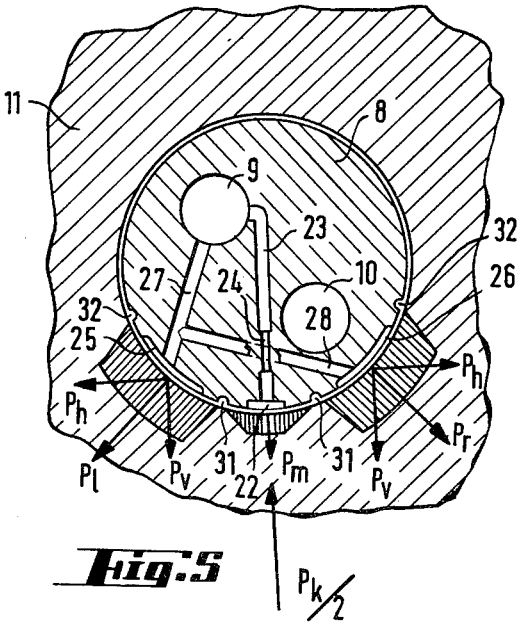
FIG. 5 illustrates a view taken on line V—V of FIG. 2.

Referring to FIG. 2, a further pair of hydrostatic bearing pockets 22 are provided in the cylindrical portions 8 of the pintle 2 with each pocket 22 facing a respective side wall 11, 12 on an opposite side of the pintle 2 from the port 14. As shown in FIG. 5, each pocket 22 communicates with the high-pressure bore 9 via a duct 23 and a throttle 24. As above, each throttle 24 serves to deliver a throttled flow of the high-pressure medium to a bearing pocket 22.

In addition, an additional pair of bearing pockets 25, 26 are disposed in each cylindrical portion 8 of the pintle 2 in facing relation to the side walls 11, 12 of the guide member 7. Each of these pockets 25, 26 is also connected to the high pressure bore 9 via a duct 27 and a branch 28, respectively. As indicated in FIG. 5, each of the pockets 25, 26 receives an unthrottled flow of pressure medium.

Referring to FIG. 4, separating grooves 30 are provided between the web 17 and the webs bounding the bearing pockets 18. Likewise, as shown in FIG. 5, separating grooves 31 are provided between the bounding webs of the hydrostatic bearing pockets 22 and the bounding webs of the associated unthrottled bearing pockets 25, 26. Similar separating grooves 32 are also provided on the outside of the bearing pockets 25, 26 to define the width of the bounding webs therefore.

For the following description of the operation of the machine it will be assumed that the machine is operating as a pump and that the guide member 7 and the cylinder block 1 rotate in the direction indicated by the arrow 107*w* in FIG. 1. On this assumption, the port 14 is on the high-pressure side and the bore 9 forms the pressure medium discharge duct, while bore 10 forms the intake duct. Referring to FIGS. 4 and 6, the resultant force $P_i$ forming beneath the pistons 4 in the region of the port 14 is directed towards the pintle 2. This force $P_i$ is counteracted by a force $P_a$ originating from the pressure medium in the port 14 and its magnitude depends on the width of the webs 17. This force is such that it is equal to from 70% to 95% of the force $P_i$. The remaining 30% to 5% of the $P_i$ is applied in the two hydrostatic bearing pockets 18, in which two equal forces $P_t$ are produced to counteract the force $P_i$. In this way, the bearing forces between the cylinder block 1 and the pintle 2 are compensated.

As will be seen from FIGS. 1 and 2, the pistons 4 situated near the port 14 exert a resultant force $P_k$ on the guide member 7 which is taken by the cylindrical portions 8 via the side walls 11 and 12. The force at each portion is in fact $\frac{1}{2} P_k$. Referring to FIGS. 5 and 7, each force 178 $P_k$ is compensated for by a force $P_m$, which is supplied in the hydrostatic bearing pocket 22 and which is equal to from 30% to 5% of the force $\frac{1}{2} P_k$, and two forces $P_l$ and $P_r$ which are supplied in the bearing pockets 25 and 26. The forces $P_r$ and $P_l$ are each resultants to two force components $P_h$ and $P_v$, the two components $P_v$ together making up 70% to 95% of the force $\frac{1}{2} P_k$.

The arrangement and construction of the bearings according to the invention allow reliable operation of the machine throughout the range.

Alternatively, it is also possible to provide two hydrostatic bearing pockets fed with throttled pressure medium from the bore 9 on each side of the port 14 instead of one bearing pocket 18 on each side. It is also possible for the bearing pockets 25 and 26 receiving the unthrottled supply to be disposed, not peripherally, but axially on each side of each hydrostatic bearing pocket 22 if the width of the side walls 11 and 12 so allows. This construction of the side wall mounting can be further modified if a bearing pocket is disposed around each hydrostatic bearing pocket 22 fed with throttled pressure medium. For example, such a bearing pocket would have a closed space of rectangular contour.

What is claimed is:

1. A hydrostatic piston machine comprising a pintle having an axis;

a cylinder block rotatably mounted on said pintle;

a plurality of peripherally distributed pistons slidably mounted in said cylinder block radially relative to said pintle, each said piston having a support surface at an outer end thereof;

an annular guide member having a pair of side walls rotatably mounted on said pintle about an axis eccentric to said longitudinal axis and a plurality of plane guide surfaces, each said guide surface having a respective piston support surface guided thereon and being disposed tangentially of a circular cylindrical surface having an axis eccentric to said axis of said pintle;

a pair of ports in said pintle facing said cylinder block;

a first bore in said pintle and communicating with one of said ports to conduct an unthrottled flow of high-pressure hydraulic medium;

a second bore in said pintle and communicating with the other of said ports to conduct low-pressure hydraulic medium;

a pair of hydrostatic bearing pockets in said pintle facing said cylinder block on opposite sides of said one port;

a pair of throttles, each said throttle connecting a respective pocket with said first bore for throttling a flow of high-pressure medium;

a second pair of hydrostatic bearing pockets in said pintle, each said pocket of said second pair facing a respective side wall on an opposite side of said pintle from said one port;

a second pair of throttles, each said throttle of said second pair connecting a pocket of said second piar of pockets to said first bore for throttling a flow of high-pressure medium; and a third pair of bearing pockets in said pintle, each said pocket of said third pair facing a respective side wall on said opposite side and communicating with said first bore to receive an unthrottled flow of high-pressure medium.

2. A hydrostatic piston machine as set forth in claim 1 wherein a fourth pair of bearing pockets is disposed in said pintle, each said pocket of said fourth pair facing a respective side wall on said opposite side and communicating with said first bore to receive an unthrottled flow of high-pressure medium, each said pocket of said fourth pair being disposed on an opposite side of a hydrostatic bearing pocket of said second pair.

3. A hydrostatic piston machine as set forth in claim 1 wherein said one port and said pockets receiving an unthrottled flow are of a size each that a hydraulic force produced therein compensated from 70% to 95% of a bearing force between said cylinder block and pintle and between each said side wall and pintle, respectively and said hydrostatic pockets receiving a throttled flow are of a size such that a hydraulic force produced therein compensates from 30% to 5% of said force.

* * * * *

UNITED STATES PATENT AND TRADEMARK OFFICE

CERTIFICATE OF CORRECTION

PATENT NO. : 4,328,739

DATED : May 11, 1982

INVENTOR(S) : Peter Rutz

It is certified that error appears in the above—identified patent and that said Letters Patent is hereby corrected as shown below:

Column 4, line 67, change "178 $P_k$" to --1/2 $P_k$--

Column 6, line 18, change "piar" to --pair--

Signed and Sealed this

Tenth Day of August 1982

[SEAL]

Attest:

GERALD J. MOSSINGHOFF

Attesting Officer

Commissioner of Patents and Trademarks